United States Patent [19]

Vidnovic

[11] 4,084,821

[45] Apr. 18, 1978

[54] MAGNETIC COLLECTION DEVICE FOR BINGO CHIPS AND SIMILAR GAME PARTS

[76] Inventor: Sam S. Vidnovic, 2803 Lafayette St., McKeesport, Pa. 15132

[21] Appl. No.: 806,752

[22] Filed: Jun. 15, 1977

Related U.S. Application Data

[63] Continuation-in-part of Ser. No. 674,485, Apr. 7, 1976, Pat. No. 4,046,383.

[51] Int. Cl.[2] ..... A63F 9/00

[52] U.S. Cl. ..... 273/148 R; 294/65.5

[58] Field of Search ..... 273/148 R; 294/65.5

[56] References Cited

U.S. PATENT DOCUMENTS

| | | | |
|---|---|---|---|
| 2,970,002 | 1/1961 | Laviano | 294/65.5 |
| 2,970,003 | 1/1961 | Heath et al. | 273/148 R X |
| 3,023,879 | 3/1962 | Cafferty et al. | 294/65.5 UX |
| 3,921,983 | 11/1975 | Taylor | 273/148 R |

*Primary Examiner*—Anton O. Oechsle
*Attorney, Agent, or Firm*—Buell, Blenko & Ziesenheim

[57] ABSTRACT

An apparatus for collecting bingo chips or other game parts. The parts are picked-up by a magnet and deposited in a container. The permanent magnet disengages the chips for reuse in play upon contacting the container. In one embodiment the container is of non-magnetic material and has L-shaped sides, an open top, a front wall, an open trough and a contoured base and back member. The magnet is movably disposed in a housing and has flanges attached thereto which extend outside the housing. The magnet is disengaged from magnetic association with the chips when the flanges engage the rim of the open top and the magnet is moved away from the interior surface of the bottom of the housing. After the chips have fallen into the container they are easily removed from the open trough.

2 Claims, 11 Drawing Figures

MAGNETIC COLLECTION DEVICE FOR BINGO CHIPS AND SIMILAR GAME PARTS

This application is a continuation-in-part of my copending application Ser. No. 674,485 filed Apr. 7, 1976, now U.S. Pat. No. 4,046,383.

This invention relates to a device for picking up markers used in playing games. Many games such as bingo require the player to use a large number of markers or chips as indicators. At the conclusion of the game the player must remove these chips and prepare for the start of another game. This device uses metal bingo chips and a magnet encased in a housing to clear the playing boards. The chips are magnetically attracted to the bottom of the housing containing the magnet. The chips are released when the magnet is moved away from the housing bottom.

A person playing a large number of bingo cards simultaneously encounters the problem that when the game is concluded, all the chips must be removed before the next game is begun. The cards must be cleared of all chips and the chips must be collected so that they can be conveniently used in the next game, all within a very short time period. One traditional method has been to tilt all the cards so that the chips slide off and then scrape the chips into a pile. This manual method is satisfactory but requires considerable dexterity and energy if it is to be used with more than a few bingo cards for a normal bingo night. A large portion of bingo players are older and cannot endure this constant maintenance of the bingo chips. This portion of the bingo players are forced to play only one or two cards per game, which limits their enjoyment and their number of wins. The present invention greatly simplifies the tasks of clearing the cards and collecting the chips.

In the past people have used iron washers and horseshoe magnets to collect the chips. But the magnets were clumsy; and in many instances it was difficult and time consuming to remove the washers from the magnet.

When magnetic pick-up devices have been used, they either do not provide a release or have a complex, difficult to operate mechanism. I provide for a release of the markers or chips with little energy or dexterity required by the user. The user/player need merely place the magnet housing on top of the empty container to release the chips.

I provide for a magnetic pick-up of bingo chips from the cards and a quick system for release of the chips in a container so they are immediately ready to resume play. The bingo chips or markers must be capable of being attracted by a magnetic force. Steel or iron chips are satisfactory and indeed common iron washers will work properly. A light weight chip is preferred, because the weight of the chips will limit the total number of bingo chips that can be picked-up in a single pass of the magnet. For this reason, ferric alloy chips having a metallic coating or composition chips having iron particles encapsulated will allow a maximum number of chips to be picked-up. In most games such as bingo the chip need only cover a number; hence it can be very thin. A thin composition chip with iron fillings embedded will optimize the number of chips that can be picked-up at one time. Because the device works on magnetic attraction rather than mechanical holding, there are little physical restraints on the construction or design of the marker or chip. Chips could be round, square or any other shape. In games where it is required that the player see through the marker either washer shaped rings or clear plastic discs with a metallic coating on the outer circumference can be used.

I provide a permanent magnet contained in a nonmetallic housing. This housing has sufficient space above the magnet to allow the magnet to move a distance away from the bottom, so that the magnetic field at the bottom of the housing is reduced. This reduction in magnetic field intensity releases the chips, allowing them to fall into a container. The magnet fits inside the housing so as to freely move in a direction away from the bottom. The sides of the housing act as a guide in this movement of the magnet.

The preferred form is composed of four parts: a metallic disc, a container having an open top, a second container or housing having a fixed top and bottom, and a disc shaped permanent magnet. All parts except the disc and the magnet are non-metallic and non-magnetic; preferably a hard plastic. The magnet should be sized to fit the bottom of the hollow housing. The magnet should be free to slide axially within this housing and free to rest upon the interior bottom. The housing should be slightly smaller in size than the inside dimensions of the container. Two studs are attached to the magnet and project through slots in the side of the housing. The slots are elongated from top to bottom and allow the magnet to move freely from the top to bottom inside the housing. These studs project far enough outside the housing so as to engage the top rim of the container when the housing is concentrically placed in the container. It is these studs that shift the magnet relative to the bottom of the housing.

In the accompanying drawings, I have shown a present preferred embodiment of the invention in which.

FIGS. *4a* through *4f* show successive isometric views of the sequential operation of the device of this invention.

Figure 5:
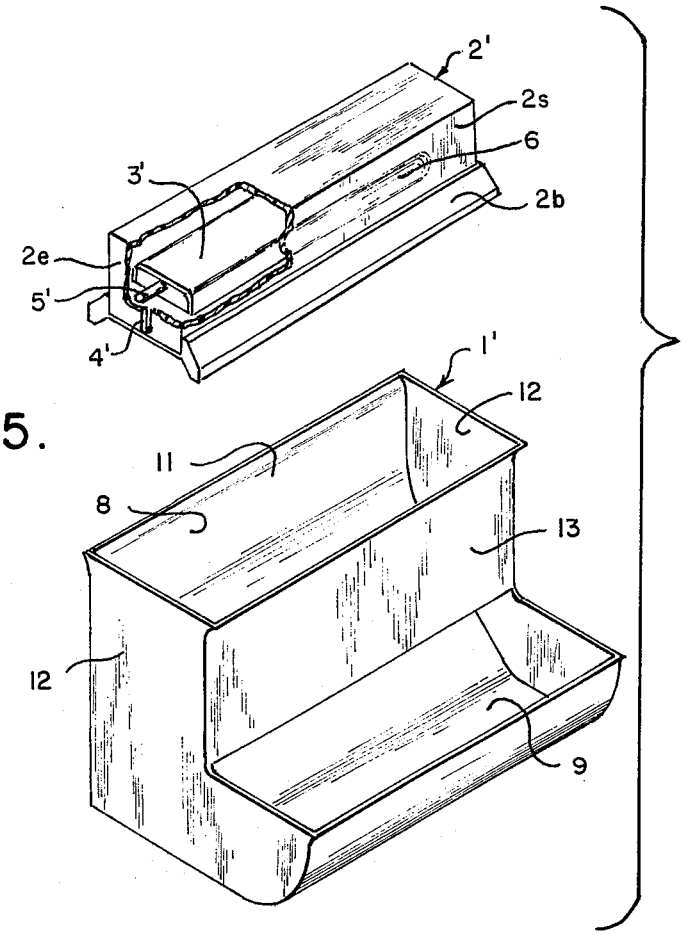

FIG. 5 is a perspective view of a second embodiment in which the housing is sectioned to show the magnet.

Figure 6:
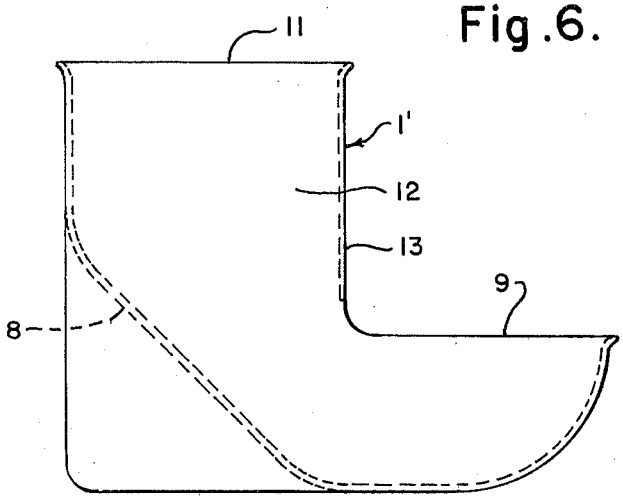

FIG. 6 is an end elevational view of the container of the embodiment of FIG. 5.

Figure 1:
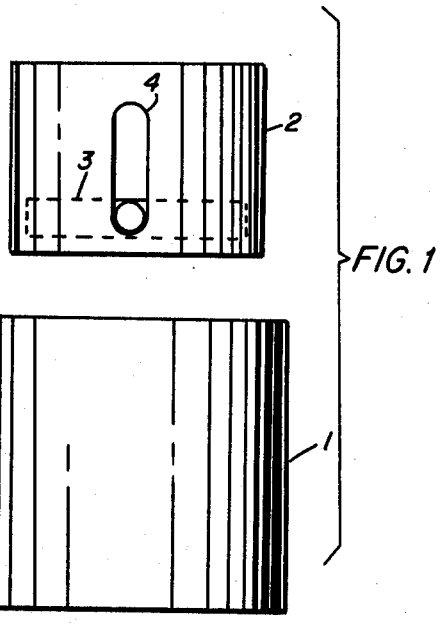
FIG. 1 is an elevational view showing a preferred embodiment of the container and housing with the magnet in the down position.
Figure 3:
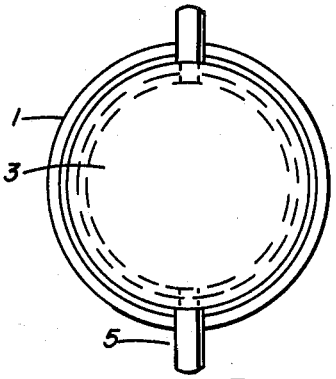
FIG. 3 is a top view of the same embodiment showing the housing positioned in the container.
Figure 2:
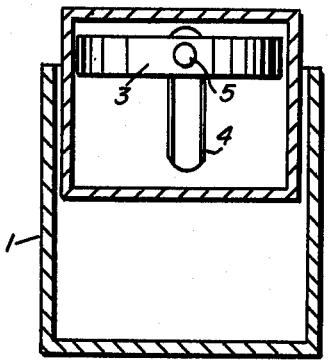
FIG. 2 is a cross sectional view of the same embodiment showing the housing in the container and the magnet in the up position.
Figure 4A:
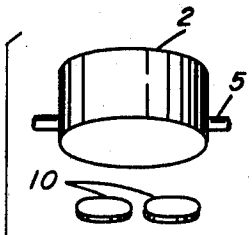
Figure 4B:
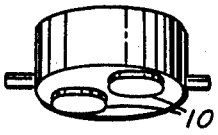
Figure 4C:
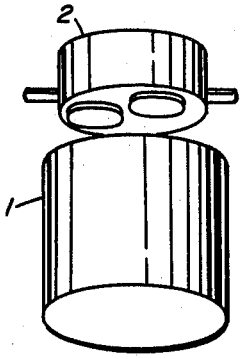
Figure 4D:
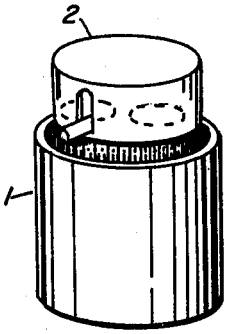
Figure 4E:
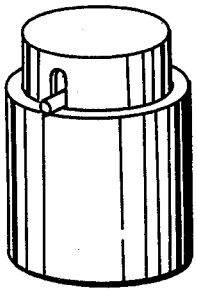
Figure 4F:
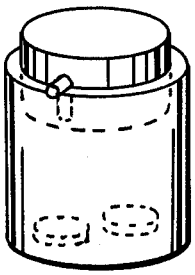

Referring to FIGS. 1, 2 and 3, I have illustrated a cylindrical container 1 having an open top and a fixed enclosed bottom made of non-metallic, non-magnetic material. An enclosed cylindrical housing 2 is sized to fit axially within the container. This housing 2 is constructed of similar non-metallic material and has two slots 4 in the outer wall 180° apart. A permanent magnet 3 in the shape of a thick disc is loosely fitted within the housing 2. The magnet is polarized so that the opposite sides of the disc have opposite polarity; this axial polarity allows non-polarized chips to be attracted to the top or bottom of the magnet. This invention is not limited to a specific magnet design, and the use of a more efficiently designed magnet is within this invention.

This magnet is guided within the housing 2 for axial movement by two slots 4 in the housing 2. Attached to the magnet 3 are two studs 5 that travel within the slots 4. These studs 5 project outside the housing 2 so that the movement of the magnet 3 can be controlled from outside the housing 2. The studs 5 project sufficiently to contact the top rim of container 1 when the housing 2 is placed partially inside the container 1 as shown in FIG. 2.

FIGS. 4*a* through 4*f* show the sequence of operating the device so as to pick-up a metallic bingo chip 10. That sequence is as follows: The housing 2 is brought in close proximity to the chips 10 while gravity holds the magnet 3 in the down position, FIG. 4*a*. The chips 10 are attracted by the magnet 3, picked-up and held securely against the outside bottom of the housing 2, FIG. 4*b*. When a number of chips 10 are picked-up the housing 2 is positioned above the container 1, FIG. 4*c*. As the housing 2 is pushed into the container 1, the studs 5 engage the rim of the container 1 and move the magnet 3 in an upward direction, FIG. 4*d*. As the magnet 3 rises relative to the bottom of the housing 2, the magnetic field on the chips 10 is reduced and the chips 10 fall into the container 1, FIG. 4*e*. When the magnet 3 is at the top of the housing 2, little magnetic attraction remains at the bottom of the housing 2 and the chips 10 are collected in the bottom of the container 1, FIG. 4*f*.

Referring to FIGS. 5 and 6, a second preferred embodiment comprises a container 1′ having parallel L-shaped sides 12, an open top 11, a front wall 13, an open trough 9 and contoured base and back member 8. This container is made of non-metallic, non-magnetic material. An enclosed rectangular housing 2′ constructed of similar non-metallic material is sized to fit into the open top 11 of the container 1′. A slot 4′ is provided in each end panel 2*e* of the housing 2′ and a bar type magnet 3′ is inserted into the housing 2′. Attached to each end of the bar type magnet 3′ is a stud 5′ which passes through and travels within the slot 4′ in each end panel 2*e*. When the housing 2′ is inserted into the open top 11 of the container 1′ the studs 5′ engage the sides 12 permitting the lower half of the housing 2′ to enter the container 1′ while the magnet 3′ remains at the top of the container 1′. I prefer to make the width of the housing 2′ smaller than the width of the container opening and to provide indentations or finger grips 6 on the side panels 2*s* of the housing 2′ to make it easier to insert the housing 2′ into the container 1′. Nevertheless, the base 2*b* of the housing 2′ can be only slightly smaller in width than the container opening 11′ to provide a snug fit of the housing 2′ into the container 1′. The shape of the container in this embodiment permits easy removal of the chips, either individually or in groups, from the container.

In the foregoing specification, I have set out certain preferred embodiments of my invention, however, it will be understood that this invention may otherwise be embodied within the scope of the following claims.

I claim:

1. An apparatus for collecting game playing markers comprising:

(a) a plurality of markers of material which is attracted by a magnetic force;

(b) a magnet;

(c) a hollow non-magnetic housing adapted to receive said magnet, (1) said housing having sufficient interior dimension to allow said magnet to be moved a significant distance away from the interior surface of the bottom of said housing; and (2) said magnet being normally disposed against said interior surface of the bottom of said housing whereby said markers are attracted to and held against the exterior surface of the bottom of said housing;

(d) means for moving said magnet within said housing away from the interior surface of the bottom of said housing whereby said markers are released; and (e) a container of non-magnetic material having L-shaped sides, an open top, a front wall, open trough, and contoured base and back member, said container being adapted to engage and activate said magnet moving means when said housing is inserted in said open top to move said magnet away from the interior surface of the bottom of said housing to release the markers into said container.

2. The apparatus of claim 1 wherein said magnet moving means are flanges fixably attached to said magnet and extending outside said housing and movable with respect to said housing and adapted to engage the rim at the opening of said container.

* * * * *

UNITED STATES PATENT OFFICE

CERTIFICATE OF CORRECTION

Patent No. 4,084,821 Dated April 18, 1978

Inventor(s) Sam S. Vidnovic

It is certified that error appears in the above-identified patent and that said Letters Patent are hereby corrected as shown below:

Column 1, line 62, "fillings" should read --filings--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*